US009285751B2

(12) United States Patent
Kondo

(10) Patent No.: US 9,285,751 B2
(45) Date of Patent: Mar. 15, 2016

(54) DECURLER AND IMAGE FORMING APPARATUS

(71) Applicant: KYOCERA Document Solutions Inc., Osaka (JP)

(72) Inventor: Kazuhisa Kondo, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/583,455

(22) Filed: Dec. 26, 2014

(65) Prior Publication Data

US 2015/0185677 A1 Jul. 2, 2015

(30) Foreign Application Priority Data

Dec. 27, 2013 (JP) ..... 2013-273387

(51) Int. Cl.
*G03G 15/00* (2006.01)
*B65H 29/70* (2006.01)

(52) U.S. Cl.
CPC ..... *G03G 15/6576* (2013.01)

(58) Field of Classification Search
CPC ... G03G 15/00; G03G 15/6576; B65H 29/70; B65H 23/34
USPC ..... 399/406
See application file for complete search history.

(56) References Cited

U.S. PATENT DOCUMENTS 4,924,269 A * 5/1990 Hasegawa ..... G03B 27/542 399/178
2011/0236102 A1 9/2011 Furushige et al.

FOREIGN PATENT DOCUMENTS

| | | | | |
|---|---|---|---|---|
| JP | 3662508 | | 4/2005 | |
| JP | 2006036489 | A * | 2/2006 | ..... B65H 29/70 |
| JP | 2009029554 | A * | 2/2009 | ..... G03G 15/00 |
| JP | 2011-219270 | | 11/2011 | |

* cited by examiner

*Primary Examiner* — Nguyen Ha
*Assistant Examiner* — Wyn Ha

(57) ABSTRACT

A decurler is operable to remove curl from a recording medium and includes a first roller, a second roller, a casing, a roller drive section, a casing rotary drive section, a housing, and a pair of cam members. The casing includes first and second supporting portions rotatably supporting the first and second rollers, respectively, with the first and second rollers pressed into engagement against each other movably away from each other. Each of the pair of cam members is mounted to the casing rotatably about a rotational axis of the casing independently of the casing and includes a circular hole. The circular hole in the cam member includes first to third recesses formed at circumferentially different portions of an inner periphery thereof so that an outer periphery of the first supporting portion is engageable with the first to third different recesses depending upon the rotation of the casing.

5 Claims, 14 Drawing Sheets

DECURLER AND IMAGE FORMING APPARATUS

INCORPORATION BY REFERENCE

This application claims priority to Japanese Patent Application No. 2013-273387 filed on Dec. 27, 2013, the entire contents of which are incorporated by reference herein.

BACKGROUND

The present disclosure relates to decurlers and image forming apparatuses and particularly relates to a technique for adjusting a decurling force.

Some of image forming apparatuses and like apparatuses are provided with a decurler operable to remove curl from a recording medium. The decurler includes an elastically deformable soft roller and a hard roller made harder than the soft roller and is configured to decurl a recording paper sheet at a nip region between both the rollers. There are also proposed, to ensure suitable decurling in response to changes over time and changes in a surrounding environment, a decurling mechanism in which the positions of the soft and hard rollers relative to a recording paper sheet passing through the nip region between them can be changed and a decurling mechanism in which the pressing force of a pair of rollers at the nip region between them can be changed.

SUMMARY

A technique further modified from the above known techniques is proposed as an aspect of the present disclosure.

A decurler according to an aspect of the present disclosure is a decurler operable to remove curl from a recording medium and includes a first roller, a second roller, a casing, a roller drive section, a casing rotary drive section, a control section, a housing, and a pair of cam members.

The first roller is configured to rotate about an axis of a first rotary shaft and made elastically deformable.

The second roller is made harder than the first roller and configured to rotate about an axis of a second rotary shaft parallel to an axial direction of the first rotary shaft and nip a recording medium at a nip region formed by pressure engagement of the second roller against the first roller to decurl the recording medium.

The casing includes a pair of flanges and a third rotary shaft and is rotatable about an axis of the third rotary shaft, each of the pair of flanges bearing an associated one of both ends of the first rotary shaft of the first roller and an associated one of both ends of the second rotary shaft of the second roller in a state where the first and second rollers are pressed into engagement against each other to allow adjustment of a center distance between the first and second shafts, the third rotary shaft being mounted to the pair of flanges and disposed parallel to the first and second shafts to extend outward beyond outside surfaces of the pair of flanges.

The roller drive section is configured to drive the pair of the first and second rollers into rotation.

The casing rotary drive section is configured to rotate the casing via the rotary shaft about the axis of the rotary shaft.

The control section controls driving of the casing rotary drive section.

The housing includes a guide member configured to guide the recording medium to the nip region between the first and second rollers and rotatably supports the casing.

The pair of cam members are annular cam members, each cam member being relatively rotatably mounted to a surface of an associated one of the pair of flanges and including a guide hole shaped to have circumferentially different inside diameters. The guide hole allows a first supporting portion rotatably supporting the first roller and a second supporting portion rotatably supporting the second roller to be inserted therein and is engageable at circumferentially different portions thereof with each of outer peripheries of both the first and second supporting portions depending upon an amount of rotation of the casing about the axis of the third rotary shaft.

An image forming apparatus according to another aspect of the present disclosure includes an image forming section and the aforementioned decurler.

The image forming section is configured to form an image on the recording medium.

DETAILED DESCRIPTION

Figure 1:
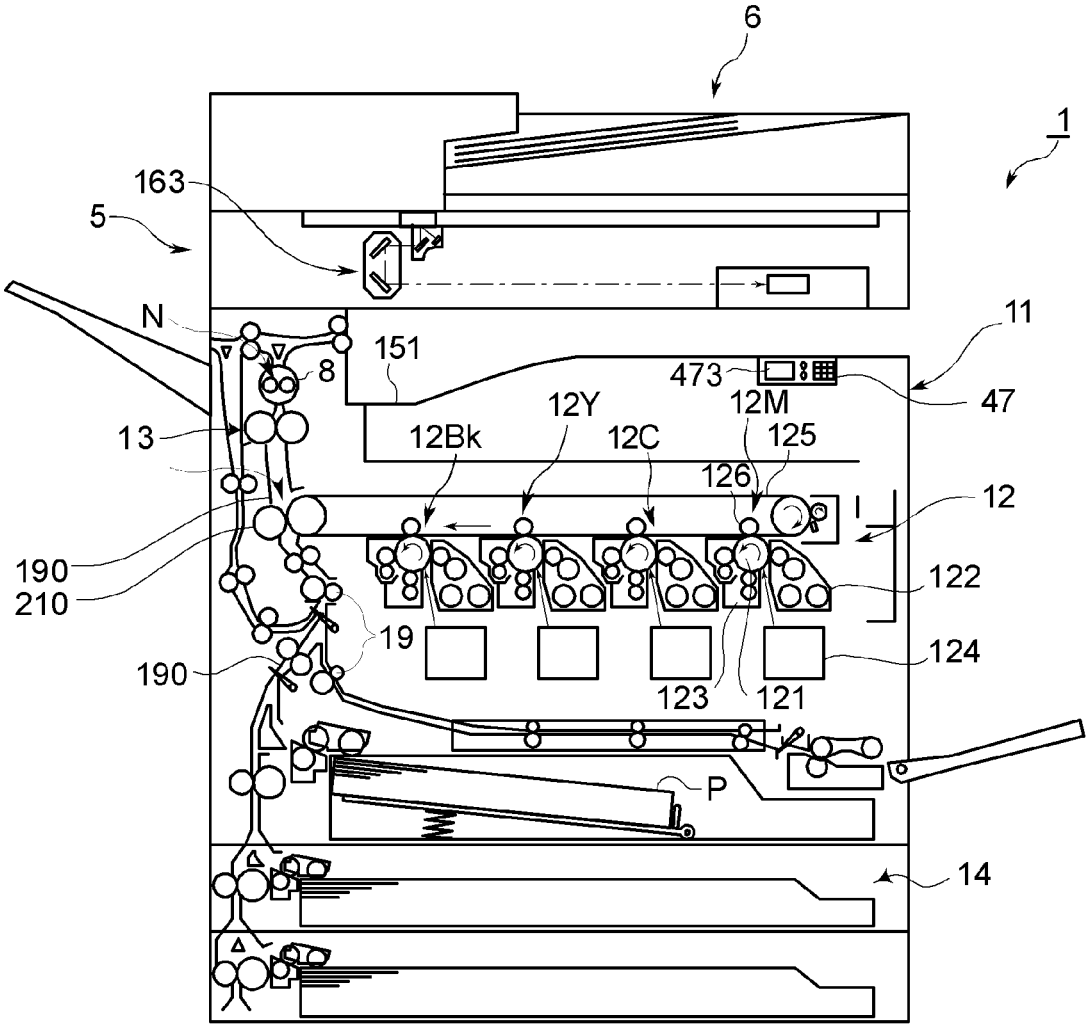
FIG. 1 is a front cross-sectional view showing the structure of an image forming apparatus according to one embodiment of the present disclosure.

Hereinafter, a description will be given of a decurler and an image forming apparatus according to one embodiment of the present disclosure with reference to the drawings. FIG. 1 is a front cross-sectional view showing the structure of the image forming apparatus according to the one embodiment of the present disclosure.

The image forming apparatus 1 according to the one embodiment of the present disclosure is a multifunction peripheral having multiple functions including, for example, a copy function, a print function, a scan function, and a facsimile function. The image forming apparatus 1 is made up so that an apparatus body 11 thereof includes an operating section 47, an image forming section 12, a fixing device 13, a paper feed section 14, a document feed section 6, a document reading section 5, and so on.

In an image forming operation of the image forming apparatus 1, the image forming section 12 forms a toner image on a recording paper sheet P serving as a recording medium fed from the paper feed section 14, based on image data generated by the document reading operation, image data stored on the internal HDD or other image data. The image forming section 12 includes four image forming units 12M, 12C, 12Y, and 12Bk for different colors. Each image forming unit 12M, 12C, 12Y, 12Bk includes a photosensitive drum 121, a charging device 123, an exposure device 124, a developing device 122, and a primary transfer roller 126. The image forming section 12 further includes: an intermediate transfer belt 125 whose outer peripheral surface has an image carrying surface to which respective toner images formed by the four image forming units are to be transferred; and a secondary transfer roller 210 configured to transfer a multicolor toner image formed on the surface of the intermediate transfer belt 125 to a recording paper sheet P. The fixing device 13 is configured to fix the toner image on the recording paper sheet P by the application of heat and pressure using a heat roller and a pressure roller. The recording paper sheet P on which the multicolor image has been fixed by the completion of the fixing treatment is discharged to a paper output tray 151.

The apparatus body 11 is internally provided with a decurler 8 in a paper conveyance path 190 downstream of the fixing device 13 in the direction of conveyance of the recording paper sheet P. A conveyance roller pair 19 provided in the paper conveyance path 190 are configured to convey the recording paper sheet P toward the decurler 8. The recording paper sheet P is decurled, at a nip region N between first and second rollers (to be described hereinafter) provided in the decurler 8, by the application of pressure from the first and second rollers.

Figure 2:
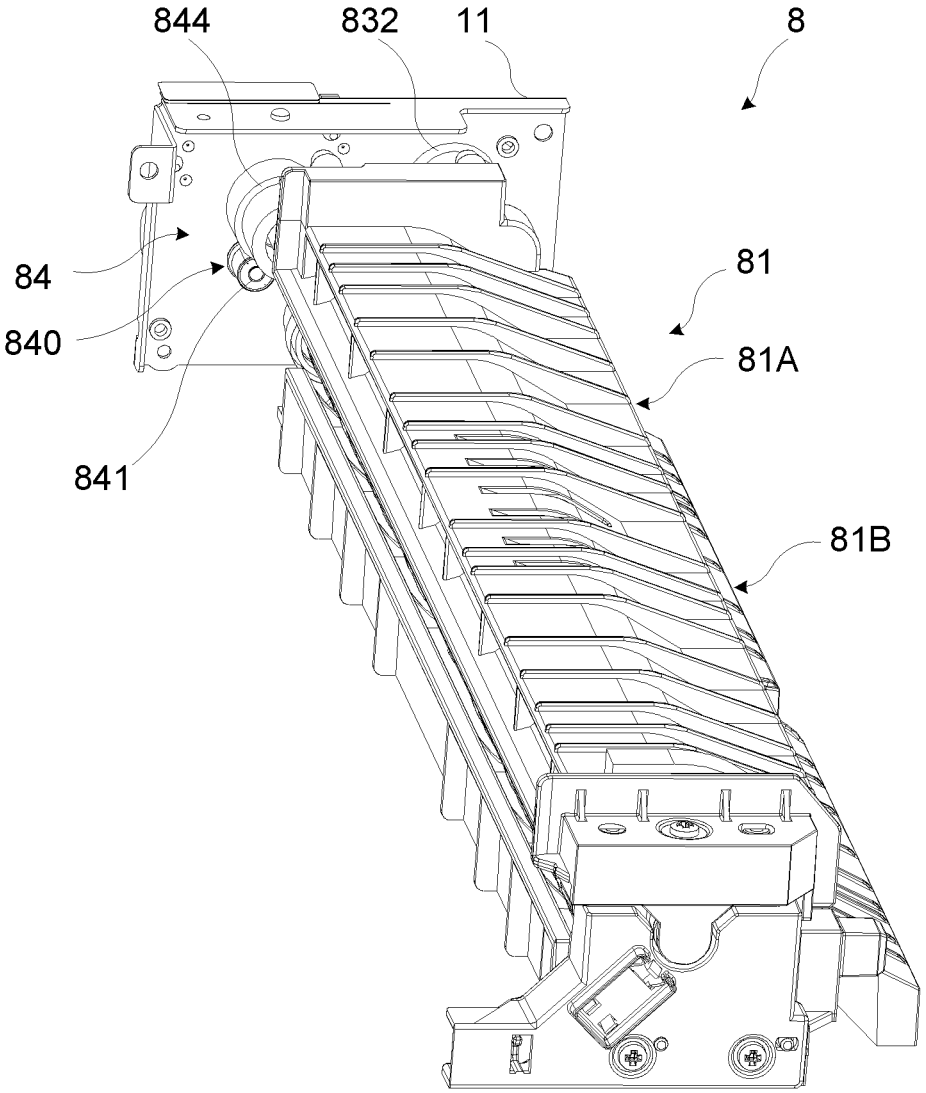
FIG. 2 is a perspective view showing a decurler.
Figure 3:
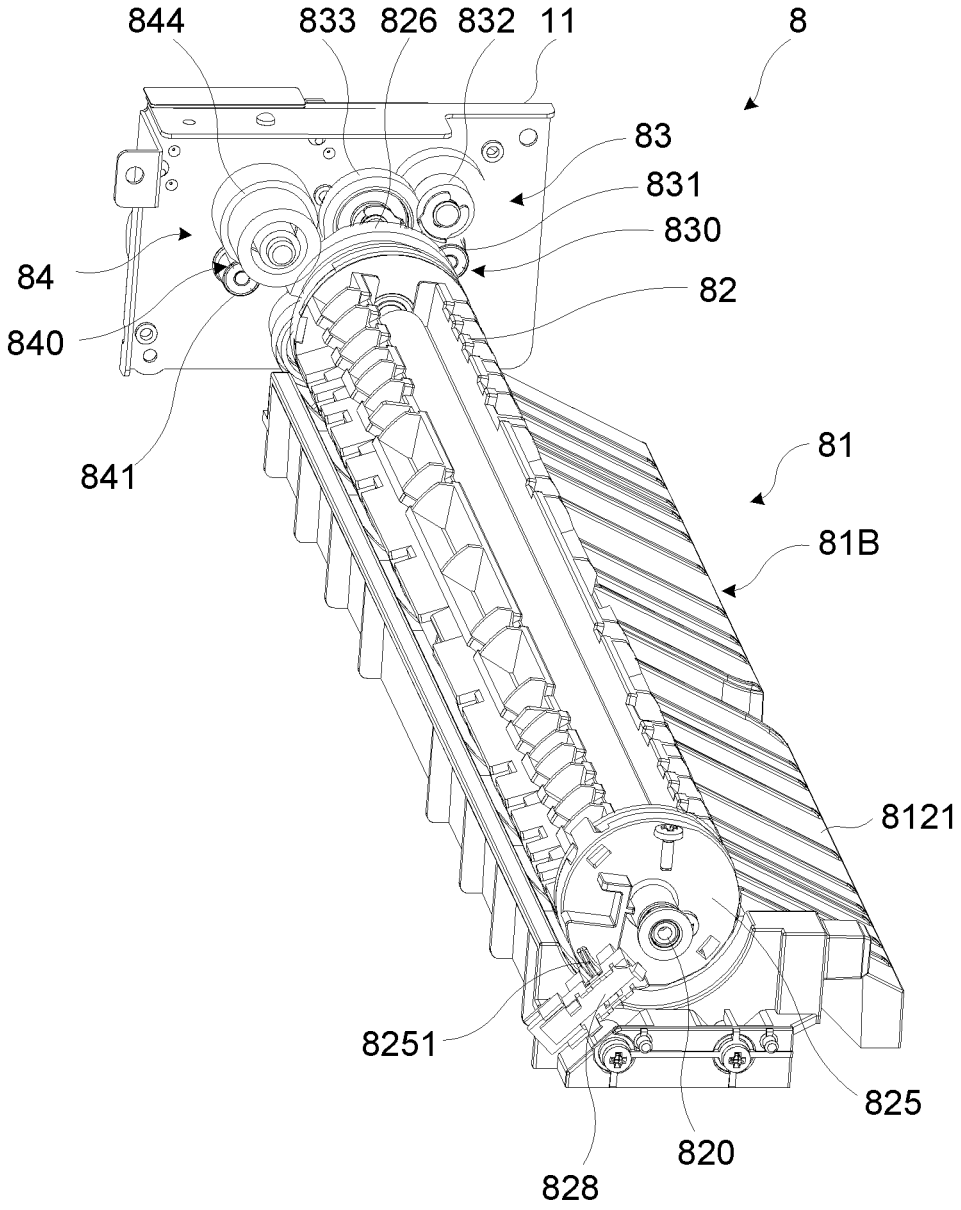
FIG. 3 is a perspective view showing a state where an upper housing is removed from the decurler.
Figure 4:
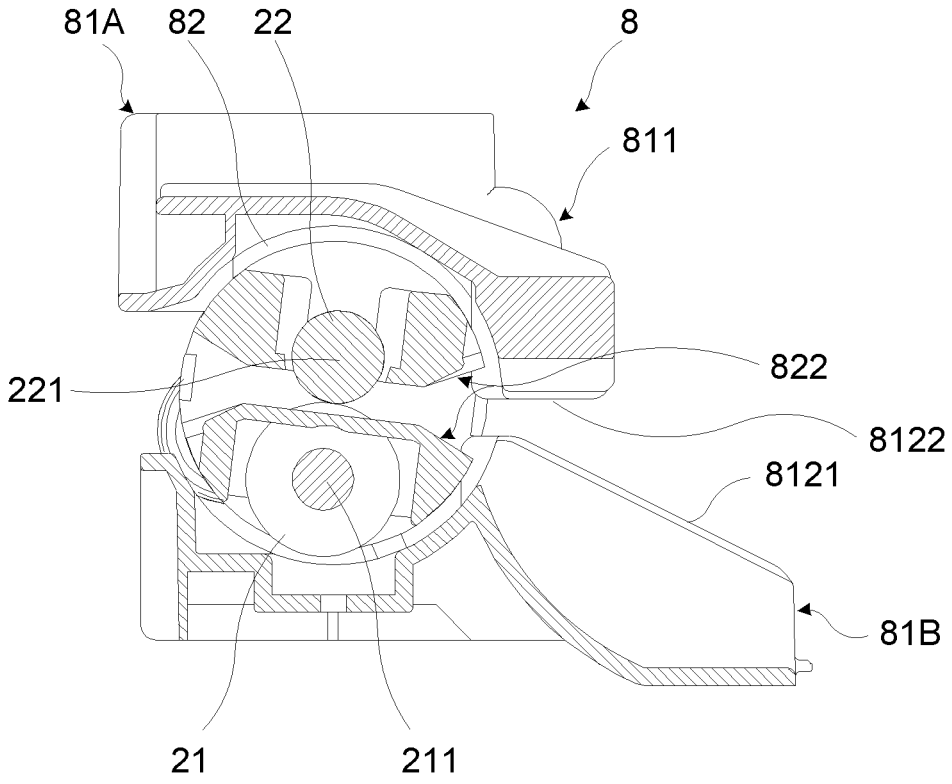
FIG. 4 is a side cross-sectional view showing an internal structure of the decurler.

Next, a description will be given of the decurler 8. FIG. 2 is a perspective view showing the decurler 8, FIG. 3 is a perspective view showing a state where an upper housing is removed from the decurler 8, and FIG. 4 is a side cross-sectional view showing the internal structure of the decurler 8.

The decurler 8 constitutes a unit including a housing 81, a casing 82, a roller drive section 83, and a casing rotary drive section 84.

The housing 81 includes an upper housing 81A and a lower housing 81B. The lower housing 81B constitutes a lower portion of the housing 81 and is provided below the casing 82. The upper housing 81A constitutes an upper portion of the housing 81 and is provided to cover the casing 82 from above. The casing 82 is disposed rotatably about the axis of a rotary shaft 820 relative to the upper housing 81A and the lower housing 81B. The lower housing 81B includes an inside guide portion 8121 operable to guide the recording paper sheet P toward the casing 82. An outside guide portion 8122 forming the underside of the upper housing 81A and the inside guide portion 8121 of the lower housing 81B constitute part of the paper conveyance path 190, which functions to guide the recording paper sheet P being conveyed from the fixing device 13 by the conveyance roller pair 19 to an internal guide member 822 (the guide member described in What is claimed is) provided inside the casing 82.

The casing 82 contains a first roller 21 and a second roller 22 which are held inside the casing 82. The recording paper sheet P having entered between the outside guide portion 8122 and the inside guide portion 8121 is guided toward the casing 82 by a portion of the paper conveyance path 190 defined by the outside guide portion 8122 and the inside guide portion 8121. The casing 82 includes the inner guide member 822 formed to guide the recording paper sheet P having been conveyed in the above manner to the nip region N between the first roller 21 and the second roller 22.

The first roller 21 is supported to the casing 82 rotatably about the axis of a first rotary shaft 211. The casing 82 further includes a pair of flanges 823 formed as its side walls forming both ends in the axial direction of the first rotary shaft 211. The flanges 823 are provided with their respective first supporting portions 710 and the first roller 21 is rotatably supported via these first supporting portions 710 by the casing 82. The first roller 21 is a roller made by fixing a soft member around the first rotary shaft 211.

The above soft member used for the first roller 21 is a flexible elastic member, such as a synthetic resin member. This elastic member is made of an elastically deformable material, such as rubber or foam. A plurality of such elastic members are disposed as the above soft member on the first rotary shaft 211 of the first roller 21 at regular intervals in the axial direction of the first rotary shaft 211. The intervals of the elastic members are determined according to the width of a sheet to be decurled.

The second roller 22 is supported to the casing 82 rotatably about the axis of a second rotary shaft 221 parallel to the axial direction of the first rotary shaft 211. The second roller 22 is rotatably supported, via respective second supporting portions 720 provided at the flanges 823, by the casing 82. The second roller 22 is made of a material harder than the first roller 21.

The second roller 22 is an elongated roller made of a hard material, such as metal, and having an outer periphery of uniform outside diameter throughout the entire axial length of the second rotary shaft 221. The first rotary shaft 211 and the second rotary shaft 221 are disposed parallel to each other. In this embodiment, the first roller 21 is designed to have a larger diameter than the second roller 22. With the rotational drive of the second roller 22 pressing against the outer periphery of the soft first roller 21, the first roller 21 is driven to rotate opposite to the direction of rotation of the second roller 22.

Figure 5:
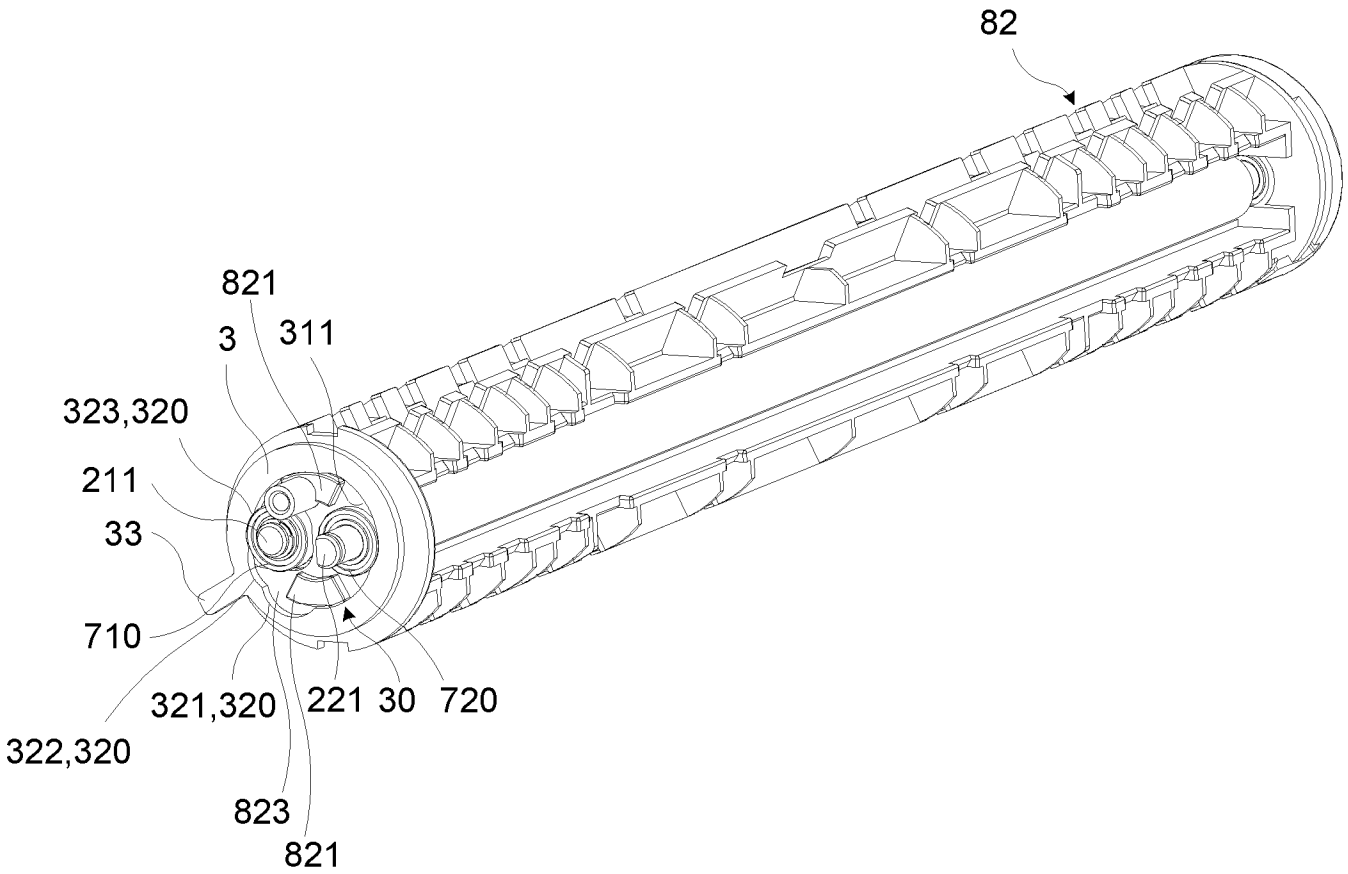
FIG. 5 is a perspective view showing a casing.

Referring also to FIG. 5, the casing 82 will be further described. FIG. 5 is a perspective view showing the casing 82.

The casing 82 has a shape extending in the axial direction of the first and second rotary shafts 211, 221 and is rotatable about the axis of the rotary shaft 820 parallel to the first and second rotary shafts 211, 221. As described previously, the first rotary shaft 211 is rotatably supported in the respective first supporting portions 710 provided at both the flanges 823 of the casing 82 and the second rotary shaft 221 is rotatably supported in the respective second supporting portions 720 provided at both the flanges 823. Furthermore, the casing 82 includes the aforementioned inner guide member 822.

The casing 82 is provided with the first supporting portions 710 supporting the first roller 21 for free rotation and the second supporting portions 720 supporting the second roller 22 for free rotation. For example, the first and second supporting portions 710, 720 are bearing members, such as bearings. The first supporting portions 710 for the first roller 21 are mounted to the casing 82 movably in a direction in which the center distance between the first and second rollers 21, 22 increases. The first roller 21 is pressed into engagement against the second roller 22. Therefore, by the resilience of the elastic member of the first roller 21, the first roller 21 and the first supporting portions 710 are subjected to a force to move them away from the second supporting portion 720 and the second rotary shaft 221. The first supporting portions 710 are urged outward in the radial direction of the casing 82 by the aforementioned resilience and this radial urgence is restricted by cam members 3 to be described hereinafter, so that the first supporting portions 710 are positioned in the radial direction of the casing 82. In this regard, the distance between the adjacent first and second supporting portions 710, 720 is maintained to form a nip between the outer peripheries of the first and second rollers 21, 22 even when the distance is maximally increased.

The roller drive section 83 and the casing rotary drive section 84 are, as shown in FIG. 3, disposed at a portion of the apparatus body 11 facing one lengthwise end of the casing 82 (one end thereof in the axial direction of the first and second rotary shafts 211, 221).

The second rotary shaft 221 of the second roller 22 is connected via a plurality of gears to be described hereinafter to the roller drive section 83 so that it can be supplied with a rotary drive force from the roller drive section 83. The roller drive section 83 includes, for example, a stepping motor. The second roller 22 rotates about the axis of the second rotary shaft 221 by a rotary drive force supplied from the roller drive section 83.

The outer peripheral portion of the first roller 21 formed by the plurality of elastic members is pressed by the outer periphery of the second roller 22 and thus engaged against the second roller 22 to dent inward in the radial direction of the first roller 21, i.e., toward the first rotary shaft 211.

Thus, the outer periphery of the first roller 21 in contact with the second roller 22 becomes an elastically depressed, deformed surface to form a curved nip region N. When the recording paper sheet P passes through the nip region N, the curl of the recording paper sheet P curved in the reverse direction to the curved shape of the nip region N is corrected. While the first roller 21 and the second roller 22 are in a first or second home position which will be described hereinafter, the conveyance roller pair 19 and the paper conveyance path 190 convey the recording paper sheet P to the nip region N between the first and second rollers 21, 22.

FIG. 4 shows a state where the first and second rollers 21, 22 is in a first home position. In the first home position, as shown in side view from the axial direction of the first and second rotary shafts 211, 221 in FIG. 4, the second roller 22 is located at an upper position in FIG. 4 and the first roller 21 is located at a lower position in FIG. 4. When the first and second rollers 21, 22 are in this first home position, the outer periphery of the first roller 21 is depressed to curve downward in FIG. 4. Therefore, if an upwardly curled recording paper sheet P passes through the inter-roller nip region N where the first roller 21 has the downwardly curved, deformed surface, the amount of upward curl of the recording paper sheet P can be reduced. The relative upper and lower positions of the first and second rollers 21, 22 can be inverted by rotating the casing 82 holding the first and second rollers 21, 22 by a rotary drive force given from the casing rotary drive section 84.

Figure 6:
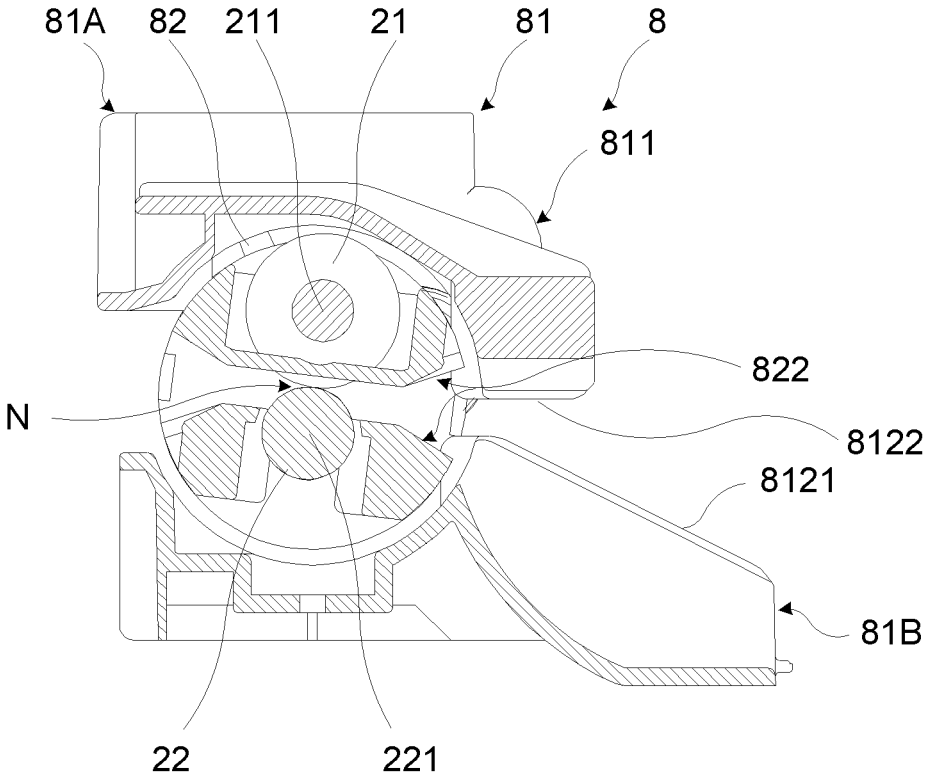
FIG. 6 is a side cross-sectional view showing the internal structure of the decurler and shows a state where first and second rollers are in a second home position.

FIG. 6 is a side cross-sectional view showing the internal structure of the decurler 8 and shows a state where the first and second rollers 21, 22 are in a second home position. In this second home position, the second roller 22 is located at a lower position and the first roller 21 is located at an upper position. When the first and second rollers 21, 22 are in this second form position, the outer periphery of the first roller 21 is depressed to curve upward in FIG. 6. Therefore, if a downwardly curled recording paper sheet P passes through the inter-roller nip region N where the first roller 21 has the upwardly curved, deformed surface, the amount of downward curl of the recording paper sheet P can be reduced.

Figure 7:
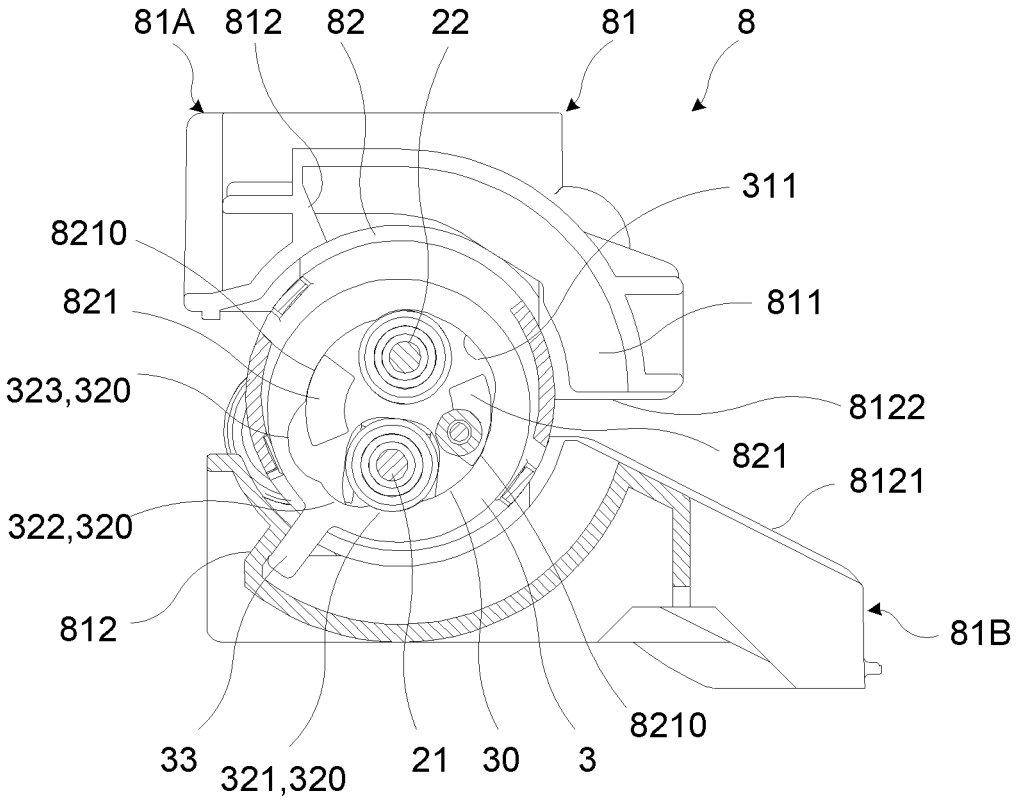
FIG. 7 is a side cross-sectional view of the casing and the housing, showing the configurations of an extension of a cam member and engagement portions of the housing.
Figure 8:
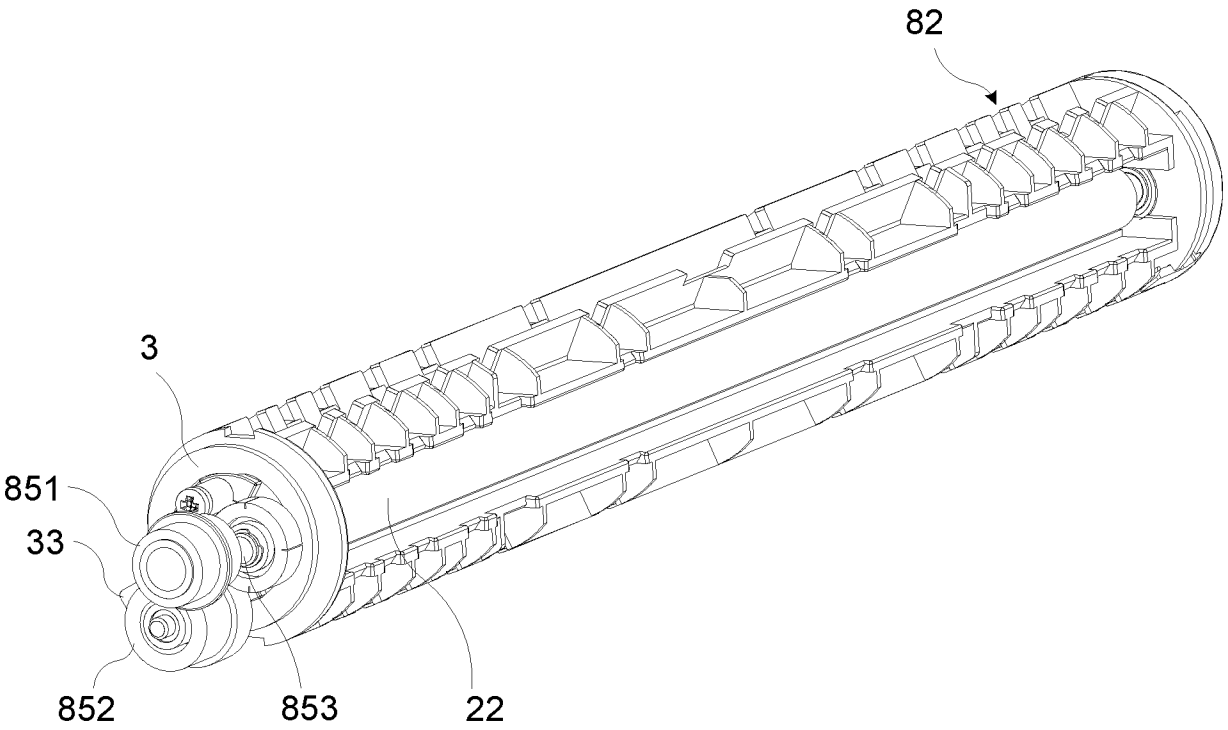
FIG. 8 shows a state where transmission gears are mounted to an end of the casing in the axial direction of a rotary shaft thereof.

Next, a description will be given of rotatable support of the first and second rollers 21, 22 to the casing 82 with reference still to FIG. 5 and also to FIGS. 7 and 8. FIG. 7 is a side cross-sectional view of the casing 82 and the housing 81, showing the configurations of an extension 33 of the cam member 3 and engagement portions of the housing 81. FIG. 8 shows a state where transmission gears are mounted to an end of the casing 82 in the axial direction of the rotary shaft 820 thereof. FIG. 8 shows the casing 82 as viewed from the opposite direction to FIG. 3.

The flanges 823 at both ends of the casing 82 in the axial direction of the rotary shaft 820 thereof are provided with their respective cam members 3. FIG. 5 shows only the cam member 3 at one end of the casing 82 in the direction of extension of the rotary shaft 820 of the casing 82 (hereinafter, referred to as the axial direction of the casing 82). The cam members 3 are mounted one to each of the ends of the casing 82 so that they can rotate about the axis of the rotary shaft 820 of the casing 82 independently of the casing 82. Each cam member 3 has a circular hole (guide hole) 30 formed in the center thereof as viewed from the axial direction of the casing 82.

The first and second rollers 21, 22 are inserted into the circular holes 30 of the cam members 30. The adjacent first and second supporting portions 710, 720 of the first and second rollers 21, 22 in the same circular hole 30 engage at their outer peripheries against the inner periphery 311 of the circular hole 30. The aforementioned radially outward movement of the first supporting portions 710 of the first roller 21 caused by the mutual resilience of the first and second rollers 21, 22 due to the pressure nip is restricted by the inner peripheries 311 of the circular holes 30. Each cam member 3 is formed in an annular shape so that at least a portion of the circumference of the inner periphery 311 of the circular hole 30 has a different diameter from the other portion thereof. Thus, by rotating the cam members 3 about the axis of the rotary shaft 820 of the casing 82 independently of the casing 82, the center distance between the axes of the first and second rotary shafts 211, 221 can be changed depending upon the rotation of the cam members 3.

Each cam member 3 is mounted to the associated flange 823 of the casing 82 so that it can rotate in its circumferential direction (the same direction as the direction of rotation of the casing 82) relative to the casing 82. Specifically, each flange 823 is provided with two raised portions 821 raised thereon in the axial direction of the first rotary shaft 211. The outer peripheral edge 8210 of each raised portion 821 has an arcuate shape and conforms to the shape of the inner periphery 311 of the circular hole 30 of the cam member 3. The two raised portions 821 are disposed at positions where their outer peripheral edges 8210 engage against the inner periphery 311 of the associated cam member 3. Thus, when each cam member 3 is mounted to the associated flange 823 to allow the outer peripheral edges 8210 of the raised portions 821 to engage against the inner periphery 311, that is, the cam member 3 is mounted to the flange 823 to fit the raised portions 821 into the inner periphery 311, the cam member 3 can rotate relative to the flange 823 and the casing 82 with its inner periphery 311 in sliding contact with the outer peripheral edges 8210 of the raised portions 821.

In assembling the casing 82 into the image forming apparatus 1, as shown in FIG. 3, a cap 825 is attached to the flange 823, to which the cam member 3 is mounted, to cover the cam member 3 and the flange 823. By providing the cap 825 in this manner, the cam member 3 can smoothly rotate without dropping out of the flange 823.

The inner periphery 311 of the circular hole 30 of each cam member 3 is provided with a plurality of recesses 320 engageable with the associated first supporting portion 710 of the first roller 21.

Specifically, the plurality of recesses 320 are a first recess 321, a second recess 322, and a third recess 323 disposed at circumferentially different portions of the inner periphery 311. The first, second, and third recesses 321, 322, 323 have different depths. The first, second, and third recesses 321, 322, 323 each individually engage with the first supporting portion 710 of the first roller 21 to hold the first supporting portion 710 at different center distances between the first and second rollers 21, 22.

The above radially movable configuration is not limited to the first supporting portions 710 of the first roller 21 and may be provided instead for the second supporting portions 720 of the second roller 22 or provided for both the first and second supporting portions 710 and 720.

The number of recesses disposed is not limited to three. For example, a larger or smaller number of recesses may be disposed. Alternatively, the circular hole 30 may be formed, without the provision of recesses, so that circumferentially different portions of the inner periphery 311 have different diameters and the center distance between the first and second rollers 21, 22 may be varied by changing the circumferential portion of the inner periphery 311 engaging against the outer periphery of the first supporting portion 710.

The first supporting portions 710 are radially movably supported by the casing 82 but mounted to the casing 82 with a restriction on their movement in the circumferential direction of the cam members 3. Therefore, when the cam members 3 relatively rotate about the axis of the rotary shaft 820 independently of the casing 82, the positions of the first and second supporting portions 710, 720 on and relative to the inner periphery 311 of each cam member 3 vary. Thus, with the above rotation, in which recess 320 the first supporting portion 710 engages is changed according to the varied positions of the first and second supporting portions 710, 720. Hence, by the relative rotation of the cam members 3 independent of the casing 82, the center distance between the first and second rollers 21, 22 can be changed.

The cam members 3 are provided with their respective extensions 33 extending radially outwardly from their outer peripheries. The extensions 33 are configured to abut against engagement portions (to be described hereinafter) formed at portions of the housing 81 opposed to both the axial ends of the casing 82. The extensions 33 function to stop, by the abutment engagement with the engagement portions, the circumferential movement of the cam members 3 (rotation about the axis of the rotary shaft 820) independently of the rotation of the casing 82 about the axis of the rotary shaft 820.

The housing 81 is provided with rail portions 811 formed at portions thereof opposed to both the axial ends of the casing 82 to allow the extensions 33 of the cam members 3 to circumferentially move in the above manner. Each rail portion 811 is provided with the aforementioned engagement portions 812 configured to, when the extension 33 circumferentially moves, abut against the extension 33 to restrict further circumferential movement of the extension 33. Therefore, when the casing 82 rotates about the axis of the rotary shaft 820 with the cam members 3 and the extensions 33 move in the same direction and then abut against the engagement portions 812, the rotation of the cam members 3 is stopped but the casing 82 continues to rotate. Thus, the casing 82 and the first and second rollers 21, 22 held by the casing 82 continue to rotate independently of the cam members 3.

Referring back to FIG. 5, the second rotary shaft 221 of the second roller 22 is provided to extend beyond one axial end of the casing 82. As shown in FIG. 5, the extending end of the second rotary shaft 221 has a crescentic shape, in side view from the axial direction, in which a portion of the shaft is axially cut out.

The roller drive section 83 includes a stepping motor 830 (see FIG. 3). The stepping motor 830 is mounted on a portion of the apparatus body 11 opposed to one axial end of the casing 82 and a drive shaft 831 thereof projects toward the casing 82. A rotary drive force supplied from the drive shaft 831 is transmitted through a first drive gear 832 and a second drive gear 833, which are rotatably supported to the apparatus body 11, to a first transmission gear 851 provided at the one axial end of the casing 82. On the casing 82 side, the rotary drive force transmitted to the first transmission gear 851 is transmitted through a second transmission gear 852 to a third transmission gear 853 simultaneously rotatable with the second rotary shaft 221 of the second roller 22. The second roller 22 is rotated about the axis of the second rotary shaft 221 by the transmitted rotary drive force.

When in this manner the second roller 22 rotates by the rotary drive force supplied from the roller drive section 83, the first roller 21 is driven to rotate with the rotation of the second roller 22 since, as described previously, the outer periphery of the first roller 21 is engaged against the outer periphery of the second roller 22.

The apparatus body 11 is further provided with a casing rotary drive section 84. The casing rotary drive section 84 includes a stepping motor 840. The stepping motor 840 is mounted on a portion of the apparatus body 11 opposed to the one axial end of the casing 82 and a drive shaft 841 thereof projects toward the casing 82. This drive shaft 841 meshes with a fourth drive gear 844 rotatably supported to the apparatus body 11.

The fourth drive gear 844 meshes with a gear 826 provided on the outer periphery of the casing 82 mounted to the apparatus body 11 in the manner described previously. Thus, a rotary drive force supplied from the casing rotary drive section 84 is transmitted to the casing 82, whereby the casing 82 rotates about the axis of the rotary shaft 820.

Figure 9:
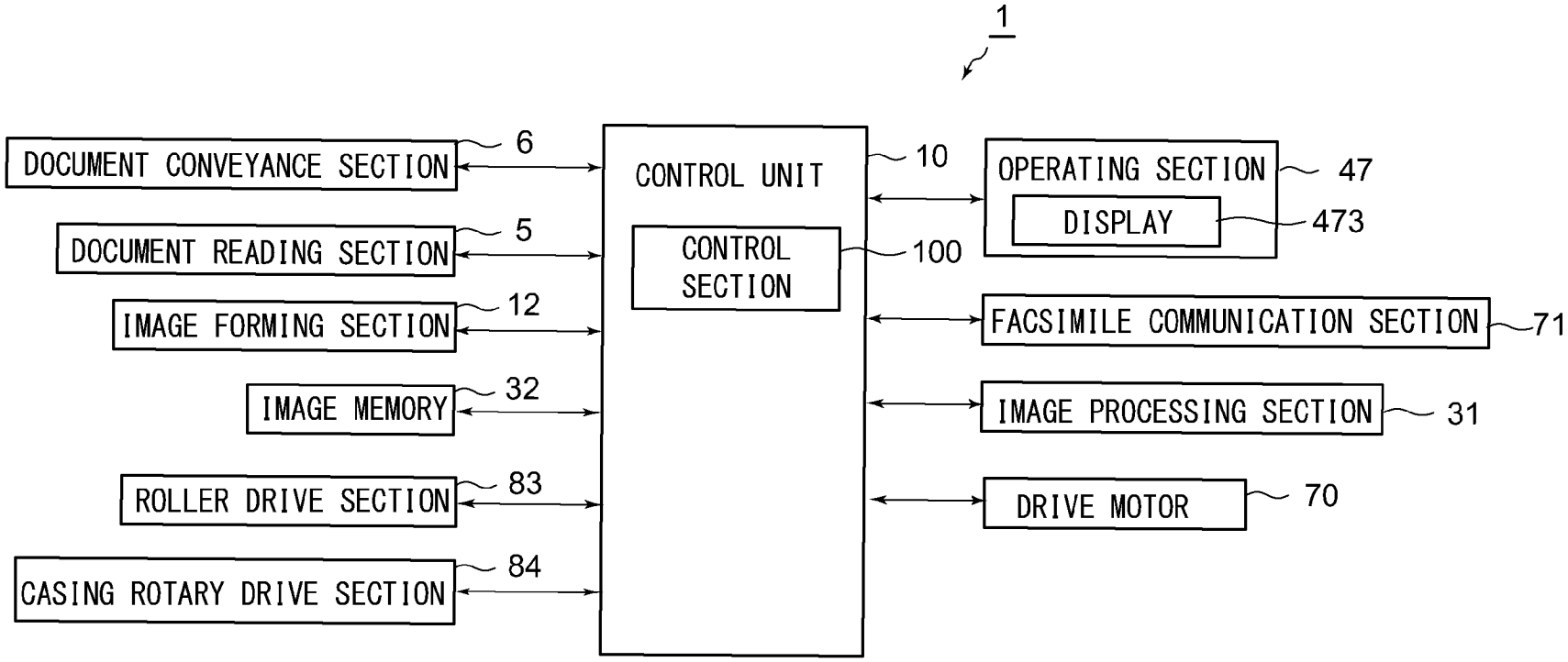
FIG. 9 is a functional block diagram showing an essential internal configuration of the image forming apparatus.

Next, a description will be given of the internal configuration of the image forming apparatus 1. FIG. 9 is a functional block diagram showing an essential internal configuration of the image forming apparatus 1.

The image forming apparatus 1 includes a control unit 10. The control unit 10 is composed of a CPU, a RAM, a ROM, a dedicated hardware circuit, and so on and governs the overall operation control of the image forming apparatus 1.

The document reading section 5 is under the control of the control unit 10 and includes a reader 163 (see FIG. 1) including a lighting part, a CCD sensor, and so on. The document reading section 5 is configured to read an image from an original document by irradiating the document with light from the lighting part and receiving the reflected light on the CCD sensor.

The image processing section 31 is configured to process, if needed, image data of the image read by the document reading section 5. For example, in order that the image read by the document reading section 5 is improved in quality after the formation of an image in the image forming section 12, the image processing section 31 performs predetermined image processing, such as shading correction.

The image memory 32 provides a region for temporarily storing data of image of the original document read by the document reading section 5 and temporarily storing data to be printed by the image forming section 12.

The image forming section 12 is configured to form an image of print data read by the document reading section 5, an image of print data received from the network-connected computer, or the like.

The operating section 47 is configured to receive operator's commands for various types of operations and processing executable by the image forming apparatus 1. The operating section 47 includes a display 473 of a touch panel type formed of a liquid crystal display.

A facsimile communication section 71 includes a coding/decoding section, a modulation/demodulation section, and an NCU (network control unit), all of which are not illustrated, and performs facsimile communication using a public telephone network.

The roller drive section 83 is, as descried previously, a mechanism configured to drive the first roller 21 and the second roller 22 into rotation and includes the stepping motor 830, the first drive gear 832, the second drive gear 833, and a driver. The driving of the roller drive section 83 is controlled by the control section 100.

The casing rotary drive section 84 is a mechanism configured to drive the casing 82 into rotation and includes the stepping motor 840, the fourth drive gear 844, and a driver. The driving of the casing rotary drive section 84 is controlled by the control section 100.

A drive motor 70 is a drive source for applying a rotary drive force to the conveyance roller pair 19 and so on of the image forming section 12.

The control section 100 totally governs the operation control of the image forming apparatus 1. The control section 100 controls the driving of the roller drive section 83 and the casing rotary drive section 84.

Figure 10D:
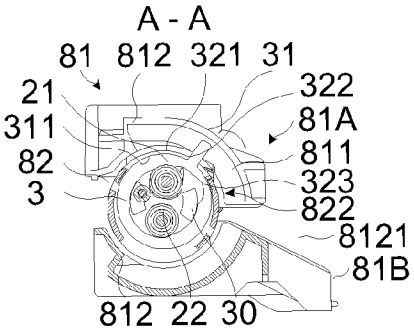
FIG. 10D is a cross-sectional view taken along the line A-A in FIG. 10A.
Figure 10E:
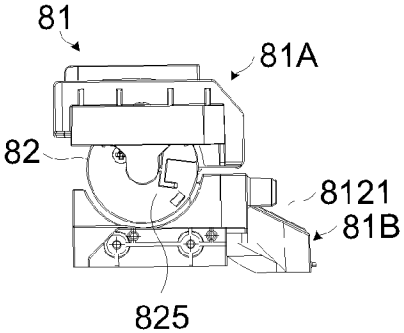
FIG. 10E is a side view of the casing and the housing.
Figure 10B:
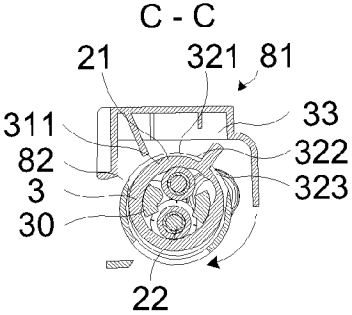
FIG. 10B is a cross-sectional view taken along the line C-C in FIG. 10A.
Figure 10C:
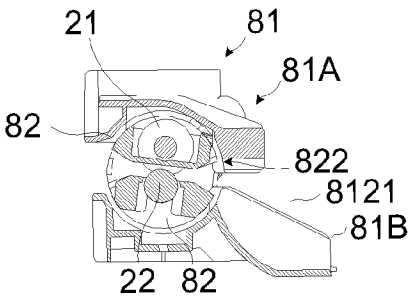
FIG. 10C is a cross-sectional view taken along the line B-B in FIG. 10A.
Figure 10A:
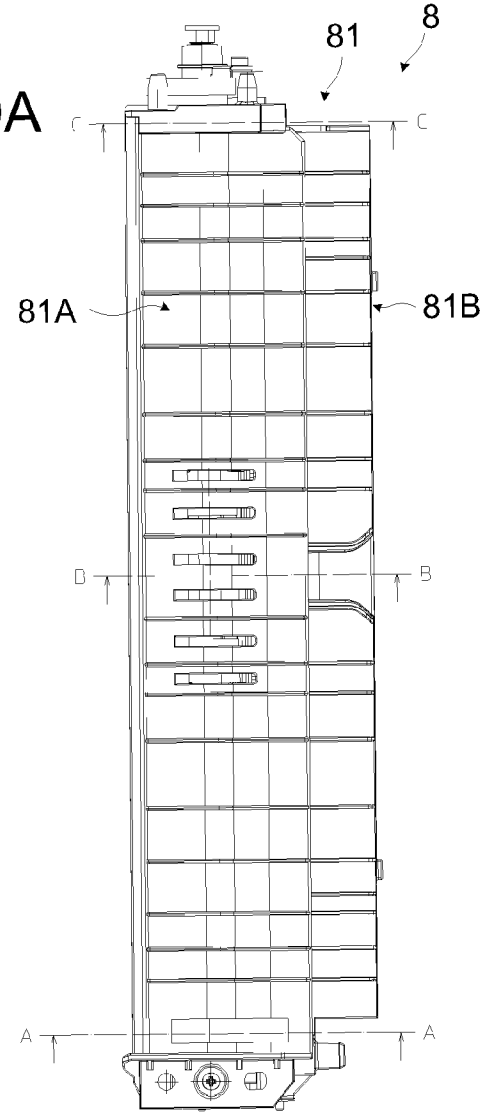
FIG. 10A is a plan view showing the casing and the housing as viewed from the housing side.

Next, a description will be given of processing for changing the center distance between the first and second rollers 21, 22 by rotating the casing 82 of the decurler 8 with reference to FIGS. 10 to 14. FIG. 10A is a plan view showing the casing 82 and the housing 81 as viewed from the housing 81 side, FIG. 10B is a cross-sectional view taken along the line C-C in FIG. 10A, FIG. 10C is a cross-sectional view taken along the line B-B in FIG. 10A, FIG. 10D is a cross-sectional view taken along the line A-A in FIG. 10A, and FIG. 10E is a side view of the casing 82 and the housing 81. FIGS. 11A-11E to FIGS. 14A-14E are similar to those described above but FIGS. 10 to 14 show different rotational positions of the casing 82.

For example, suppose that the rotational position of the casing 82 where the first and second rollers 21, 22 are in a state shown in FIGS. 10A to 10E is set as a first home position. When the first and second rollers 21, 22 are in the first home position, a recording paper sheet P is conveyed to the nip region N between the first and second rollers 21, 22 by the conveyance roller pair 19 and the paper conveyance path 190 and decurled at the nip region N. In the state shown in FIGS. 10A to 10E, the first roller 21 is located at an upper position in these figures and the second roller 22 is located at a lower position in these figures, wherein downward curl as viewed in FIG. 10 can be corrected.

In changing the direction for the decurler 8 to decurl a recording paper sheet P, the control section 100 sets the direction of rotation of the casing rotary drive section 84 to allow the casing 82 to rotate in the direction of the arrow shown in FIG. 10B and drives the casing rotary drive section 84. Specifically, the control section 100 controls the number of drive pulses to be output to the stepping motor 840 and thus rotates the stepping motor 840 to an amount of rotation at which the casing 82 rotates 180 degrees in the above direction of the arrow. As a result, the casing 82, the first roller 21, and the second roller 22 assume a second home position shown in FIGS. 11A to 11E. In the second home position, the first and second rollers 21, 22 are turned upside down relative to the first home position. Also when the first and second rollers 21, 22 are in the second home position, a recording paper sheet P is conveyed to the nip region N between the first and second rollers 21, 22 by the conveyance roller pair 19 and the paper conveyance path 190 and decurled at the nip region N. In the state shown in FIGS. 11A to 11E, the first roller 21 is located at a lower position in these figures and the second roller 22 is located at an upper position in these figures, wherein upward curl as viewed in FIG. 11 can be corrected.

Figure 11D:
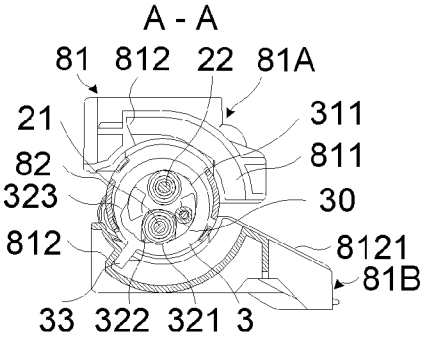
FIG. 11D is a cross-sectional view taken along the line A-A in FIG. 11A.
Figure 11E:
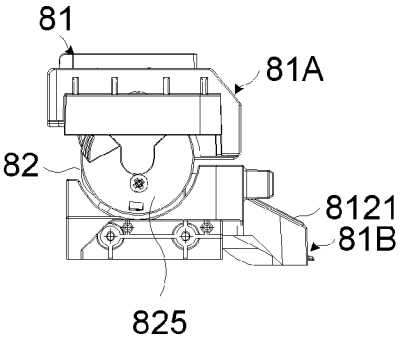
FIG. 11E is a side view of the casing and the housing.
Figure 11B:
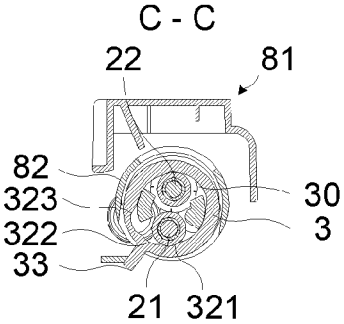
FIG. 11B is a cross-sectional view taken along the line C-C in FIG. 11A.
Figure 11C:
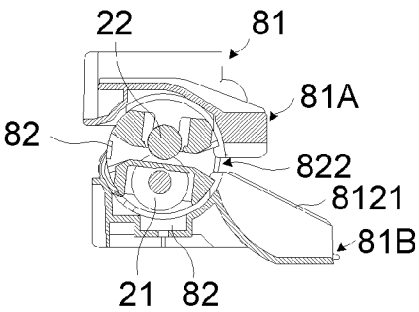
FIG. 11C is a cross-sectional view taken along the line B-B in FIG. 11A.
Figure 11A:
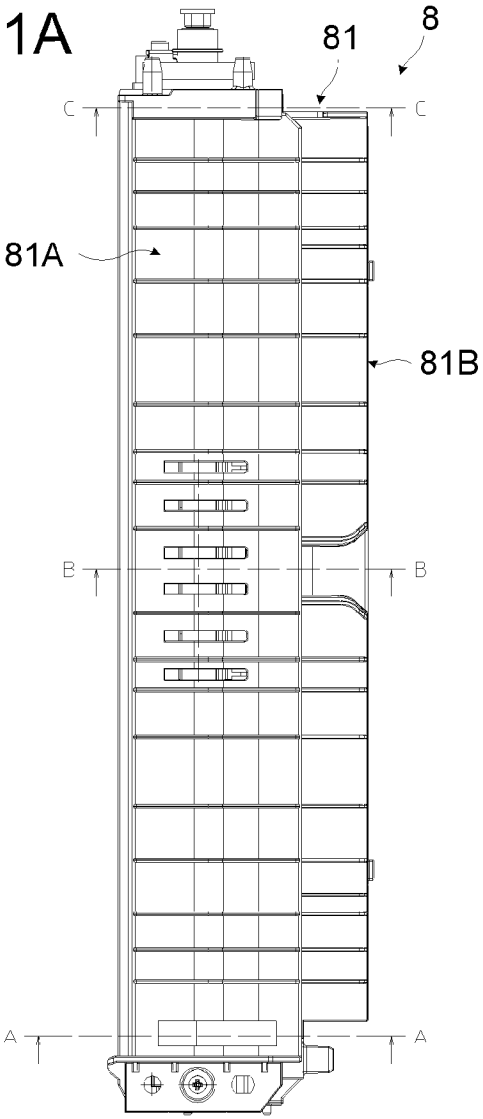
FIG. 11A is a plan view showing the casing and the housing as viewed from the housing side.
Figure 12D:
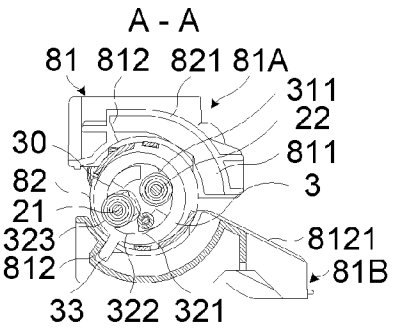
FIG. 12D is a cross-sectional view taken along the line A-A in FIG. 12A.
Figure 12E:
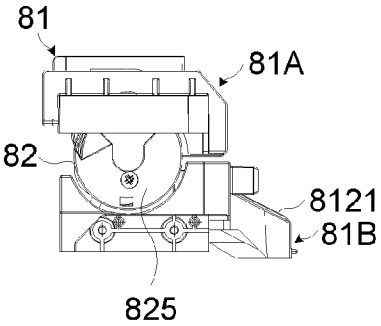
FIG. 12E is a side view of the casing and the housing.
Figure 12B:
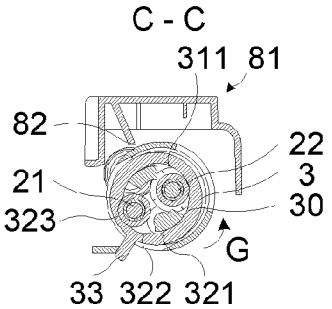
FIG. 12B is a cross-sectional view taken along the line C-C in FIG. 12A.
Figure 12C:
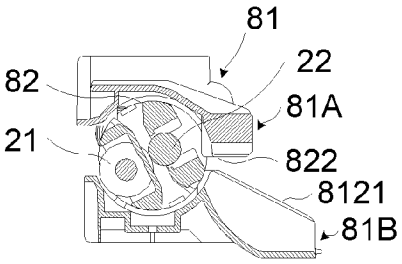
FIG. 12C is a cross-sectional view taken along the line B-B in FIG. 12A.
Figure 12A:
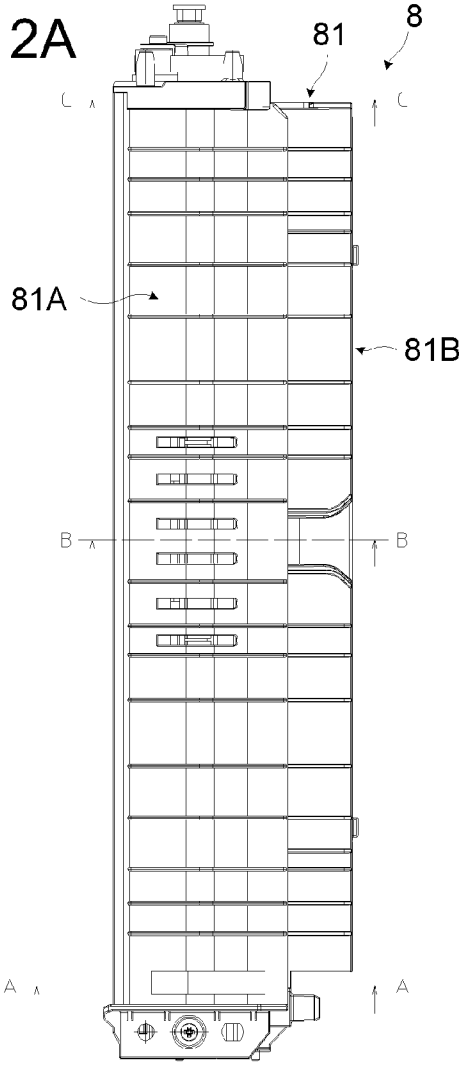
FIG. 12A is a plan view showing the casing and the housing as viewed from the housing side.
Figure 13A:
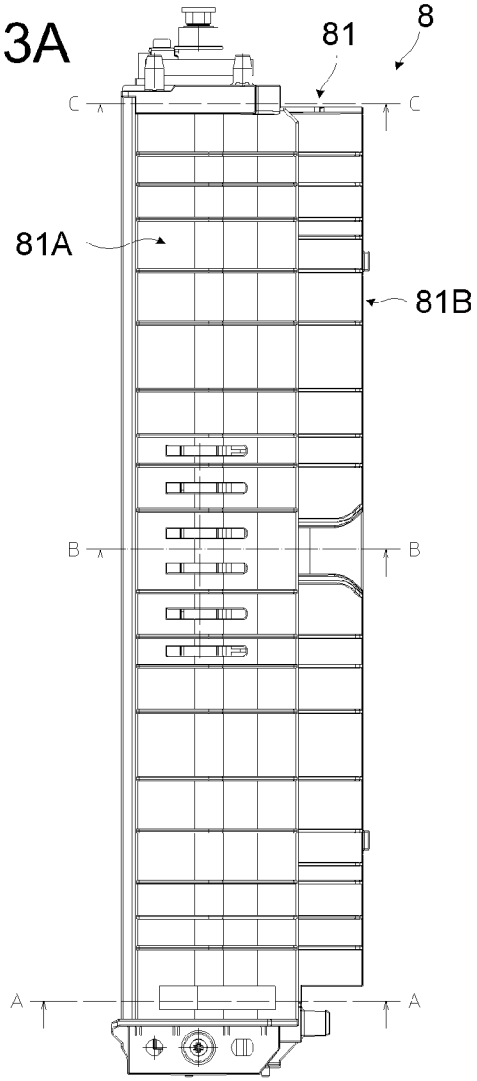
FIG. 13A is a plan view showing the casing and the housing as viewed from the housing side.
Figure 13B:
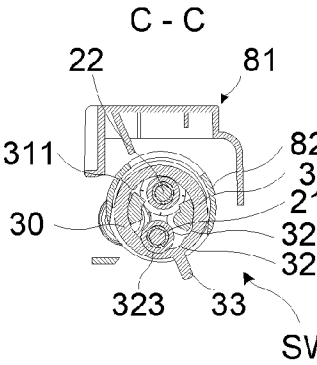
FIG. 13B is a cross-sectional view taken along the line C-C in FIG. 13A.
Figure 13C:
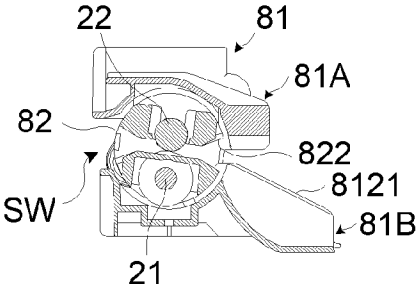
FIG. 13C is a cross-sectional view taken along the line B-B in FIG. 13A.
Figure 13D:
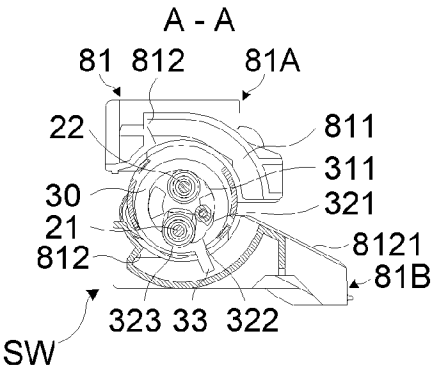
FIG. 13D is a cross-sectional view taken along the line A-A in FIG. 13A.
Figure 13E:
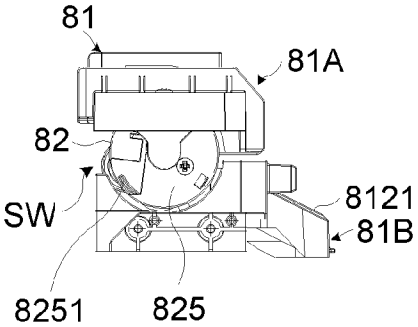
FIG. 13E is a side view of the casing and the housing.
Figure 14D:
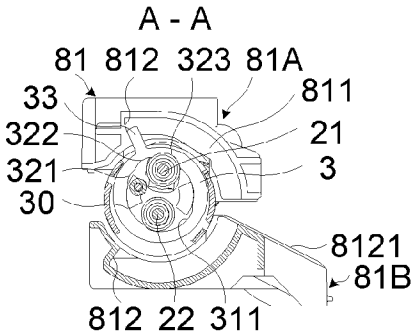
FIG. 14D is a cross-sectional view taken along the line A-A in FIG. 14A.
Figure 14E:
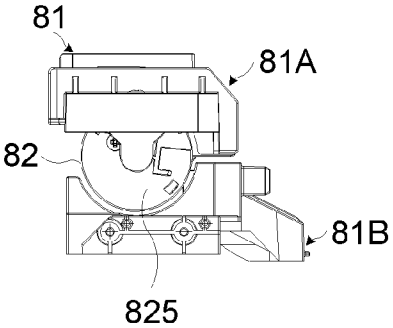
FIG. 14E is a side view of the casing and the housing.
Figure 14B:
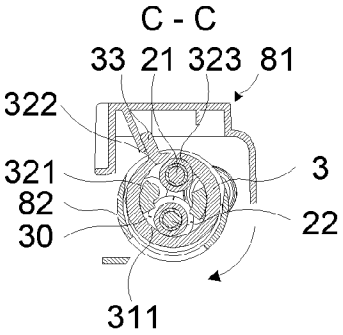
FIG. 14B is a cross-sectional view taken along the line C-C in FIG. 14A.
Figure 14C:
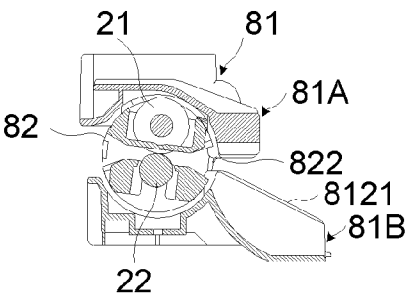
FIG. 14C is a cross-sectional view taken along the line B-B in FIG. 14A.
Figure 14A:
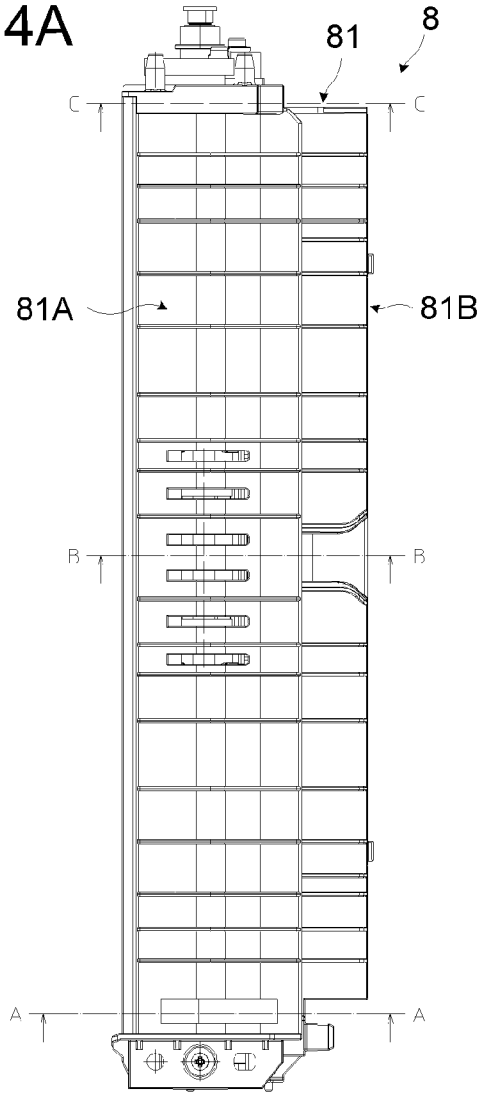
FIG. 14A is a plan view showing the casing and the housing as viewed from the housing side.

In changing the center distance between the first and second rollers 21, 22, the control section 100 drives the casing rotary drive section 84 to rotate the casing 82, for example, from the first home position shown in FIGS. 10A to 10E to the position shown in FIGS. 11A to 11E in the direction of the arrow shown in FIG. 10B. When the rotation in this direction progresses, as shown in FIGS. 11B and 11D, the extensions 33 of the cam members 3 abut against the engagement portions 812 of the lower housing 81B. As the result of this abutment, the rotation of the cam members 3 in this direction stops regardless of rotation of the casing 82. In other words, the cam members 3 relatively rotate on the respective surfaces of the associated flanges 823 of the casing 82. Meanwhile, the control section 100 still drives the casing rotary drive section 84 to allow the casing rotary drive section 84 to supply the casing 82 with a rotary drive force in the above direction of rotation.

In this case, the cam members 3 stop their rotation in the above direction owing to the abutment engagement of the extensions 33 against the engagement portions 812 but the casing 82 rotates independently of the cam members 3. Therefore, the casing 82 and the first and second rollers 21, 22 held by the flanges 823 of the casing 82 still rotate in the above direction. The control section 100 stops the rotary drive of the casing rotary drive section 84 at the point in time when the casing 82 rotates to a state shown in FIGS. 12A to 12E.

Specifically, in the state shown in FIGS. 10A to 10E, each of the first supporting portions 710 of the first roller 21 fits and engages in the first recess 321. When the casing 82 and the cam members 3 rotate and the extensions 33 of the cam members 3 then abut against the engagement portions 812 to stop the rotation of the cam members 3, only the casing 82, the first roller 21, and the second roller 22 rotate while sliding on the inner peripheries 311 of the cam members 3, so that the positions of the first and second rollers 21, 22 on and relative to the inner peripheries 311 of the cam members 3 are changed. For example, each of the first supporting portions 710 of the first roller 21 moves from the state of engagement in the first recess 321 into the third recess 323, so that, as shown in FIGS. 12A to 12E, each of the first supporting portions 710 of the first roller 21 fits and engages in the third recess 323.

In other words, the control section 100 controls the stepping motor 840 of the casing rotary drive section 84 to allow the stepping motor 840 to rotate to an amount of rotation corresponding to the rotation of the casing 82 and the cam members 3 in the direction of rotation shown in FIG. 10B necessary to disengage each first supporting portion 710 of the first roller 21 from the first recess 321 and then engage it into the third recess 323. The control section 100 can also allow the stepping motor 840 to rotate to an amount of rotation necessary to rotate the casing 82 to a state where each first supporting portion 710 of the first roller 21 engages in the second recess 322, thereby engaging the first supporting portion 710 of the first roller 21 into the second recess 322.

After driving the stepping motor 840 to accomplish the state shown in FIGS. 12A to 12E in the manner described above, the control section 100 reversely rotates the stepping motor 840 to rotate the casing 82 in the opposite direction to the previous rotation (in the direction of the arrow G shown in FIG. 12B) until the first and second rollers 21, 22 assume either the first or second home position. For example, the control section 100 drives the stepping motor 840 into rotation to rotate the casing 82 until the first and second rollers 21, 22 assume a first home position SW shown in FIGS. 13A to 13E in which the first roller 21 is located at a lower position and the second roller 22 is located at an upper position.

As shown in FIG. 3, the cap 825 is provided with a light-blocking plate 8251. The light-blocking plate 8251 is formed, near the outer peripheral edge of the cap 825, in a flat shape projecting in the length direction of the casing 82 and extending along the circumferential direction thereof. Furthermore, a photo-interrupter (sensor) 828 (see FIG. 3) is provided which includes a light-emitting part and a light-receiving part located at both sides in the radial direction of the casing 82 to interpose the light-blocking plate 8251 in non-contact with both sides between the light-emitting and light-receiving parts when the first and second rollers 21, 22 is in the first home position SW. The photo-interrupter 828 is provided to avoid interference with the light-blocking plate 8251 moving with the rotation of the casing 82. Thus, when, under conditions that the light-emitting part of the photo-interrupter 828 always emits light, the light-blocking plate 8251 comes between the light-emitting and light-receiving parts so that the light-receiving part cannot receive light from the light-emitting part, it can be detected that the first roller 21, the second roller 22, and the casing 82 are in the first home position SW.

Alternatively, the control section 100 drives the stepping motor 840 into rotation to rotate the casing 82 until the first and second rollers 21, 22 assume a second home position shown in FIGS. 14A to 14E in which the first roller 21 is located at an upper position and the second roller 22 is located at a lower position.

The control section 100 stores all the amounts and directions of rotation necessary to move the first supporting portion 710 of the first roller 21 from each of the first to third recesses 321 to 323 to the other recesses in order to shift the first supporting portion 710 from engagement in each of the first to third recesses 321 to 323 to engagement in any one of the other recesses and all the directions and amounts of rotation necessary to move the casing 82 to the first or second home position after the engagement of the first supporting portion 710 in the other recesses. The control section 100 rotates, based on the content instructed by an operator, the casing rotary drive section 84 in the direction and amount of rotation meeting the instruction.

On the other hand, in moving the first supporting portion 710 of the first roller 21 along the inner periphery 311 in the opposite direction to the above case, for example, as in the case of shifting the first supporting portion 710 from engagement in the third recess 323 to engagement in the first recess 321, the control section 100 performs the above rotation control in the reverse direction of rotation.

As thus far described, the circular hole 30 of each cam member 3 is engageable at circumferentially different portions thereof with each of the outer peripheries of both the first and second supporting portions 710, 720 depending upon the amount of rotation of the casing 82 about the axis of the rotary shaft 820.

In the above embodiment, by rotating the cam member 3 about the axis of the rotary shaft 820 independently of the casing 82 holding the first and second supporting portions 710, 720 of the first and second rollers 21, 22, each circular hole (guide hole) 30 can be engaged at circumferentially different portions thereof with the outer periphery of each of the associated first and second supporting portions 710, 720 of the first and second rollers 21, 22 depending upon the amount of rotation of the casing 82 about the axis of the rotary shaft 820. Therefore, the center distance between both the rollers 21, 22 can be changed. Thus, the pressing force of both the rollers 21, 22 at the nip region N can be changed, thereby providing a mechanism for changing the decurling force with a simple structure.

With the configuration and control described above, the center distance between the first and second rollers 21, 22 can be changed at a plurality of stages corresponding to the number of recesses 320 (three recesses, i.e., the first to third recesses 321-323, in this embodiment) formed in each cam member 3. Thus, the decurling force can be adjusted by changing the nipping strength of the first and second rollers 21, 22 (i.e., the pressing force of both the rollers).

Although the above embodiment shows a configuration in which the control section 100 controls the driving of the casing rotary drive section 84 to change the decurling force of the decurler 8, the present disclosure is not limited to this configuration. For example, in which of the first to third recesses 321-323 the first supporting portion 710 of the first roller 21 should engage may be determined not by the control section 100 controlling the driving of the casing rotary drive section 84 but by the operator manually rotating the casing 82 about the axis of the rotary shaft 820 independently of the cam members 3. In this case, the extensions 33 of the cam members 33 are not essential elements.

For example, as in the decurlers described in BACKGROUND, a mechanism for changing the decurling direction by changing the relative positions of the soft and hard rollers and a mechanism for changing the decurling force by changing the pressing force of a pair of rollers at the nip region between them have a large configuration, resulting in a large-sized decurler. This in turn increases the size of the image forming apparatus in which the decurler is mounted.

In contrast, in the above embodiment according to the present disclosure, since the center distance between the first and second rollers 21, 22 can be changed by the rotation of the casing 82, the force to decurl a recording paper sheet P can be changed with no need to complicate the structure, thus reducing the size of the decurler.

The present disclosure is not limited to the above embodiment and can be modified in various ways. The structure and processing shown in the above embodiment with reference to FIGS. 1 to 14 are merely illustrative of the present disclosure and not intended to limit the present disclosure to the above particular structure and processing.

Various modifications and alterations of this disclosure will be apparent to those skilled in the art without departing from the scope and spirit of this disclosure, and it should be understood that this disclosure is not limited to the illustrative embodiments set forth herein.

The invention claimed is:

1. A decurler operable to remove curl from a recording medium, the decurler comprising:

a first roller configured to rotate about an axis of a first rotary shaft and made elastically deformable;

a second roller made harder than the first roller and configured to rotate about an axis of a second rotary shaft parallel to an axial direction of the first rotary shaft and nip a recording medium at a nip region formed by pressure engagement of the second roller against the first roller to decurl the recording medium;

a casing including a pair of flanges and a third rotary shaft and being rotatable about an axis of the third rotary shaft, each of the pair of flanges bearing an associated one of both ends of the first rotary shaft of the first roller and an associated one of both ends of the second rotary shaft of the second roller in a state where the first and second rollers are pressed into engagement against each other to allow adjustment of a center distance between the first and second shafts, the third rotary shaft being mounted to the pair of flanges and disposed parallel to the first and second shafts to extend outward beyond outside surfaces of the pair of flanges;

a roller drive section configured to drive the pair of the first and second rollers into rotation;

a casing rotary drive section configured to rotate the casing via the third rotary shaft about the axis of the third rotary shaft;

a control section configured to control driving of the casing rotary drive section;

a housing including a guide portion configured to guide the recording medium to the nip region between the first and second rollers, the housing rotatably supporting the casing; and a pair of annular cam members, each cam member being relatively rotatably mounted to a surface of an associated one of the pair of flanges and including a guide hole shaped to have circumferentially different inside diameters, the guide hole allowing a first supporting portion rotatably supporting the first roller and a second supporting portion rotatably supporting the second roller to be inserted therein, the guide hole being engageable at circumferentially different portions thereof with each of outer peripheries of both the first and second supporting portions depending upon an amount of rotation of the casing about the axis of the third rotary shaft, wherein the guide hole in each of the pair of cam members includes a plurality of recesses formed at circumferentially different portions of an inner periphery of the guide hole, the plurality of recesses being engageable with the outer periphery of at least one of the first and second supporting portions rotatably supporting the first and second rollers to hold the at least one supporting portion so that a center distance between the first and second rotary shafts differs among engagements of the at least one supporting portion with the different recesses, and each of the pair of cam members includes an extension extending radially outwardly from an outer periphery thereof, and the housing includes an engagement portion configured to, upon unitary rotation of the casing, the first and second rollers, and the cam member together about the axis of the third rotary shaft, engage with the extension to stop rotation of the cam member about the axis of the third rotary shaft and further rotate the casing and the first and second rollers.

2. The decurler according to claim 1, wherein the control section is configured to allow the casing rotary drive section to drive the casing into rotation about the axis of the third rotary shaft to abut the extension against the engagement portion, then allow the casing rotary drive section to further drive the casing into rotation, and stop the driving of the casing rotary drive section when the casing rotary drive section further rotates the casing until the at least one of the first and second supporting portions rotatably supporting the first and second rollers is disengaged from one of the plurality of recesses and engaged in another one of the plurality of recesses located downstream in a direction of the rotation.

3. The decurler according to claim 2, wherein the control section is configured to, after stopping the driving of the casing rotary drive section when the casing rotary drive section further rotates the casing until the at least one of the first and second supporting portions rotatably supporting the first and second rollers is disengaged from one of the plurality of recesses and engaged in another one of the plurality of recesses, allow the casing rotary drive section to rotate the casing in a reverse direction until the first and second rollers reach a predetermined home position.

4. The decurler according to claim 3, wherein the control section sets two positions as the two home positions and relative positions of the first and second rollers to the recording medium are inverted between the two home positions.

5. An image forming apparatus comprising an image forming section configured to form an image on a recording medium and the decurler according to claim 1.

* * * * *